US005588281A

United States Patent [19]

Boriani et al.

[11] Patent Number: 5,588,281

[45] Date of Patent: Dec. 31, 1996

[54] METHOD OF PRODUCING CARTONS OF CIGARETTES WITH A RIGID HINGED-LID WRAPPING

[75] Inventors: Silvano Boriani; Antonio Gamberini, both of Bologna, Italy

[73] Assignee: G.D Societa' Per Azioni, Bologna, Italy

[21] Appl. No.: 440,776

[22] Filed: May 15, 1995

[30] Foreign Application Priority Data

May 16, 1994 [IT] Italy ..... B094A-0213

[51] Int. Cl.[6] ..... B65B 35/30

[52] U.S. Cl. ..... 53/443; 53/447; 53/456; 53/462; 53/466; 53/531; 53/540; 53/575

[58] Field of Search ..... 53/447, 443, 461, 53/466, 531, 540, 228, 230, 462, 202, 171, 456, 575; 206/271, 273

[56] References Cited

U.S. PATENT DOCUMENTS

| | | | |
|---|---|---|---|
| 3,125,841 | 3/1964 | Anderson | 53/228 |
| 3,585,776 | 10/1969 | Euwe | 53/447 |
| 4,028,864 | 7/1977 | Bell | 53/540 |
| 4,351,142 | 9/1982 | Focke et al. | 53/228 |
| 4,481,751 | 11/1984 | Ujhelyi | 53/447 |
| 4,617,780 | 10/1986 | Focke et al. | 53/202 |
| 4,679,379 | 7/1987 | Cassoli | 53/540 |
| 4,718,216 | 1/1988 | Focke et al. | 53/202 |
| 5,193,328 | 3/1993 | Boriani et al. | 53/228 |
| 5,216,870 | 6/1993 | Borian et al. | 53/466 |
| 5,236,084 | 8/1993 | Evers | 206/271 |

FOREIGN PATENT DOCUMENTS

| | | |
|---|---|---|
| 414422 | 9/1934 | United Kingdom . |
| 1562156 | 5/1980 | United Kingdom . |

*Primary Examiner*—John Sipos
*Assistant Examiner*—John Paradiso
*Attorney, Agent, or Firm*—Marshall, O'Toole, Gerstein, Murray & Borun

[57] ABSTRACT

A method of producing cartons of cigarettes, whereby groups of packets of cigarettes are formed wherein the packets are arranged in at least two side by side stacks, and wherein each packet in each stack is laid flat with its longer axis horizontal and aligned with the longer axis of a corresponding packet in the other stack; and each group is fed, crosswise to the longer axes of the packets and together with a flat blank from which to form a rigid hinged-lid wrapping, into a folding spindle, the bottom wall of which supports the group with the interposition of a panel of the blank corresponding to a lateral wall of the rigid wrapping.

5 Claims, 3 Drawing Sheets

METHOD OF PRODUCING CARTONS OF CIGARETTES WITH A RIGID HINGED-LID WRAPPING

BACKGROUND OF THE INVENTION

The present invention relates to a method of producing cartons of cigarettes with a rigid hinged-lid wrapping.

SUMMARY OF TEE INVENTION

According to the present invention, there is provided a method of producing cartons of cigarettes with a rigid hinged-lid wrapping, the method being characterized in that it comprises the steps of forming groups of packets of cigarettes arranged in at least two end to end stacks, and in which each packet in each stack is laid flat with its longer axis horizontal and aligned with the longer axis of a corresponding packet in the other stack; feeding a flat blank of said rigid wrapping into a position between said group and a folding spindle, the spindle facing the group in a direction crosswise to the longer axes of the packets; and feeding each group, crosswise to the longer axes of the packets and together with said flat blank, into engagement with said spindle, so as to fold the blank in contact with the spindle, and so that the bottom wall of the spindle supports the group with the interposition of a panel of the blank corresponding to a lateral wall of the rigid wrapping.

According to a preferred embodiment of the above method, said step of forming said groups of packets comprises the steps of feeding the stacks successively along a given path and in a first direction parallel to the longer axes of the packets; successively expelling the stacks from said path in a second direction substantially crosswise to said first direction; rotating each stack 90° about an axis crosswise to said first and second directions, so that said longer axes are parallel to said second direction; and again feeding the stacks, so oriented, in said second direction, so that each stack is positioned alongside another stack, thus forming a respective said group.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
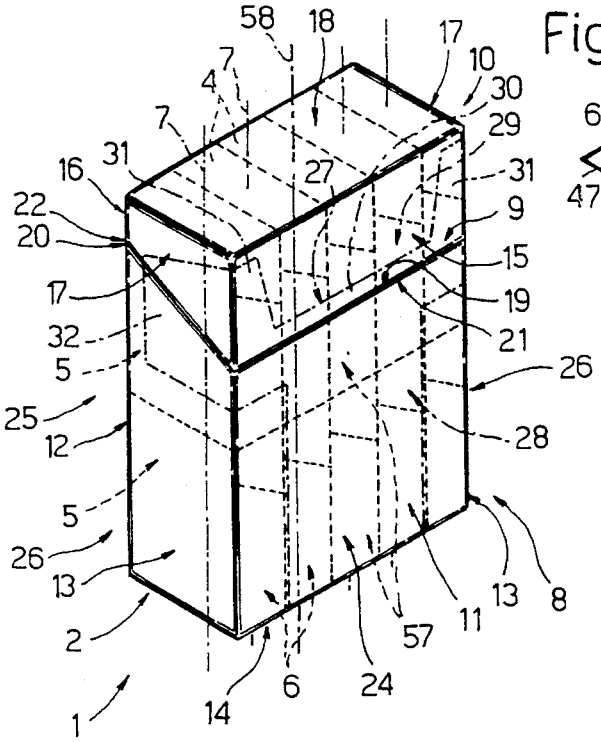
FIG. 1 shows a view in perspective of a carton of cigarettes formed using the method according to the present invention

Number 1 in FIG. 1 indicates a carton of cigarettes comprising a rigid wrapping 2 in the form of a rectangular parallelepipedon and formed from a flat blank 3 (FIG. 2) of cardboard or similar material; and a number of packets 4 of cigarettes (not shown) housed inside wrapping 2. Each packet 4 is in the form of a rectangular parallelepipedon presenting two large lateral surfaces 5 parallel to each other;

two small lateral surfaces 6 parallel to each other and perpendicular to surfaces 5; and a longitudinal axis 7 parallel to surfaces 5 and 6.

Wrapping 2 comprises a cup-shaped bottom container 8 with an open top end 9; and a cup-shaped top lid 10 hinged to container 8 so as to rotate between an open position (not shown) and a closed position (FIG. 1).

Container 8 presents a front wall 11 and a rear wall 12 facing and parallel to each other; two lateral walls 13 parallel to each other and perpendicular to walls 11 and 12; and a bottom wall 14 perpendicular to walls 11, 12 and 13.

Lid 10 presents a front wall 15 and a rear wall 16 facing and parallel to each other; two lateral walls 17 parallel to each other and perpendicular to walls 15 and 16; and a top wall 18 perpendicular to walls 15, 16 and 17. Walls 15 and 17 present a free edge 19 facing the free edge 21 of walls 11 and 13; and wall 16 presents a free edge 20 facing the free edge 22 of wall 12. Edge 19 is complementary in shape to that of edge 21, whereas edge 20 is integral with edge 22 with which it defines a hinge 23 (FIG. 2) for rotating lid 10 in relation to container 8 between said open and closed positions. Walls 11 and 15 together define the front wall 24 of wrapping 2; walls 12 and 16 together define the rear wall 25 of wrapping 2; and each wall 13 and corresponding wall 17 together define a respective lateral wall 26 of wrapping 2.

Wrapping 2 also comprises a U-shaped collar 27 projecting partially outwards of end 9 and in turn comprising a central wall 28 with a central cavity 29 facing lid 10 and defining, on wall 28, a sunken central portion 30, and two lateral wings 31 extending towards lid 10. Wall 28 is connected to the inner surface of wall 11, from which part of portion 30 and wings 3 1 projects, and is connected to two lateral walls 32 contacting the inner surface of respective walls 13 and projecting partially from walls 13 towards lid 10.

Figure 2:
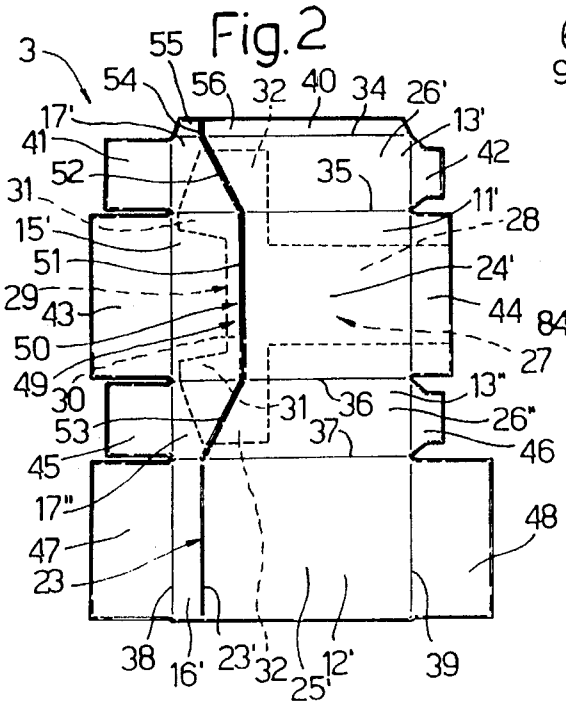
FIG. 2 shows a flat blank from which to form the wrapping of the FIG. 1 carton.

As shown in FIG. 2, wrapping 2 is formed from a substantially rectangular blank 3 of cardboard or similar material, the parts of which will be indicated, wherever possible, using the same numbering system (with ' or " signs) as for the corresponding parts of wrapping 2.

Blank 3 presents a number of preformed longitudinal bend lines 34, 35, 36, 37, and two preformed transverse bend lines 38, 39.

Lines 35 and 36 define a panel 24' between lines 38 and 39; line 37, together with lines 38 and 39, defines a panel 25'; lines 34 and 35 define a panel 26' between lines 38 and 39; lines 36 and 37 define a panel 26" between lines 38 and 39; and line 34 defines a transverse tab 40.

Lines 38 and 39 define two longitudinal tabs 41 and 42 projecting from the opposite longitudinal ends of panel 26'; two longitudinal tabs 43 and 44 projecting from the opposite longitudinal ends of panel 24'; two longitudinal tabs 45 and 46 projecting from the opposite longitudinal ends of panel 26"; and two longitudinal tabs 47 and 48 projecting from the opposite longitudinal ends of panel 25'.

Blank 3 presents a further transverse line indicated as a whole by 49, located between lines 38 and 39, and comprising a preformed bend portion 23' extending parallel to lines 38 and 39 across panel 25' and defining hinge 23; and a precut portion 50 extending across tab 40 and panels 26', 24', 26". More specifically, portion 50 comprises an intermediate portion 51 parallel to lines 38 and 39 and extending across panel 24'; two oblique lateral portions 52 and 53 extending in oppositely inclined manner across respective panels 26' and 26"; and an end portion 54 parallel to lines 38 and 39 and extending across tab 40. Line 49 divides tab 40 into two tabs 55 and 56; panel 26' into two panels 13' and 17'; panel 24' into two panels 11' and 15'; panel 26" into two panels 13" and 17"; and panel 25' into two panels 12' and 16'.

Inside wrapping 2, packets 4 are arranged in two superimposed rows 57, in each of which, axis 7 of each packet 4 is aligned with axis 7 of the corresponding packet 4 in the other row 57, and is parallel to the longer longitudinal axis 58 of wrapping 2, and each packet 4 is positioned with its large lateral surfaces 5 parallel to lateral walls 26 of the wrapping, and with its small lateral surfaces 6 respectively contacting the inner surfaces of front wall 24 and rear wall 25 of the wrapping.

Figure 3:
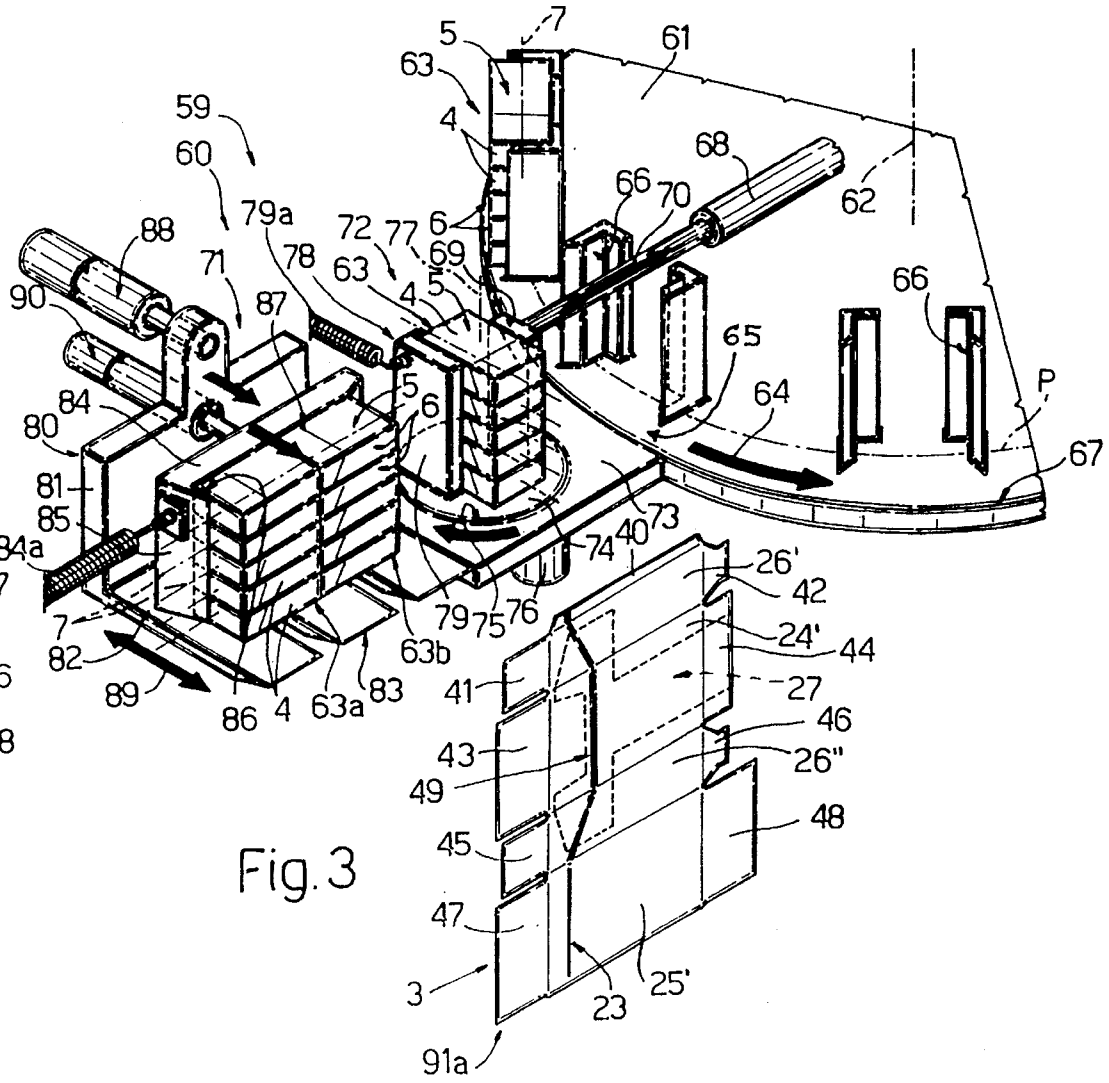
FIG. 3 shows a partial view of a unit for prodocing the FIG. 1 carton.

Number 59 in FIG. 3 indicates a cartoning machine, the input portion 60 of which comprises a conveyor in turn comprising a platform 61 rotating anticlockwise (in FIG. 3) about a substantially vertical axis 62, for step feeding a succession of stacks 63 of packets 4 in a direction 64 and along a circular path P extending through a transfer station 65. As it travels along path P, each stack 63 is housed inside a respective pocket 66 open radially inwards and outwards of platform 61, and each packet 4 in each stack 63 is housed inside pocket 66 with at least one large lateral surface 5 contacting a surface 5 of the adjacent packet 4 and parallel to the upper surface 67 of platform 61, and with its axis 7 parallel both to surface 67 and to a line tangent to path P in the position occupied at the time by respective pocket 66.

Portion 60 also comprises a pusher 68 located at station 65 and presenting a vertical suction plate 69 which is movable, in a radial direction 70 perpendicular to direction 64 and through each pocket 66, between a withdrawn idle position wherein it is located inwards of path P, and an extracted operating position wherein it is located outwards of path P for expelling stacks 63 from respective pockets 66 and feeding them successively, and perpendicular to axes 7 of packets 4, to a conveyor device 71 via an intermediate turnaround station 72.

As shown in FIG. 3, station 72 comprises a plate 73 coplanar with surface 67 and tangent to the outer periphery of platform 61; and a platform 74 coplanar with plate 73, fitted through a hole 75 formed in plate 73, and rotated clockwise (in FIG. 3) about an axis 77 parallel to axis 62 by an actuator 76. More specifically, platform 74 is rotated about axis 77 in alternate steps of 90° and 270° so as to turn the axes 7 of packets 4 in stack 63 from an initial position perpendicular to direction 70, to a final position parallel to direction 70. Platform 74 is fitted integral with a vertical, substantially L-shaped stop element 78 comprising a suction plate 79 connected by a hose **79*a* to a known suction device (not shown), and which is set to a start position perpendicular to direction 70 prior to said 90° step, and is restored to the same start position at the end of said 270° step. In the start position, element 78 cooperates with plate 69 to arrest each stack 63 on platform 74, with axes 7 of packets 4 in said initial position perpendicular to direction 70**.

Conveyor device 71 comprises a square element 80 in turn comprising a vertical wall 81 parallel to direction 70 and crosswise to surface 67, and a horizontal comblike wall 82 extending from wall 81 crosswise to direction 70 and coplanar with plate 73. Wall 82 presents a tapered wedge-shaped free end portion defined by an edge 83 parallel to direction 70, and provides for receiving and supporting stacks 63 when pusher 68 moves into the extracted operating position.

Device 71 also comprises a suction plate 84 parallel to wall 81, located on wall 82, and presenting, on the opposite side to that facing wall 81, a square appendix 85 which, together with plate 84 and wall 82, defines an assembly compartment 86 for housing a group 87 of packets 4 defined by two stacks 63 arranged end to end so that the axis 7 of each packet 4 in each stack 63 is aligned with axis 7 of the corresponding packet 4 in the other stack 63. Plate 84 is connected by a hose **84*a* to a known suction device (not shown) to retain each group 87 inside compartment 86**.

Element 80 is the terminal output element of an actuating unit 88 for moving element 80, in a direction 89 crosswise to direction 70 and perpendicular to wall 81, between an initial loading position (FIG. 3) and a final folding position (not shown); and plate 84 is the terminal output element of an actuating unit 90 fitted to wall 81 and for moving plate 84, in direction 89 and in relation to element 80, between an initial loading position (FIG. 3), and a final folding position (not shown) wherein the front surface of plate 84 (in direction 89) is substantially flush with edge 83.

Figure 4:
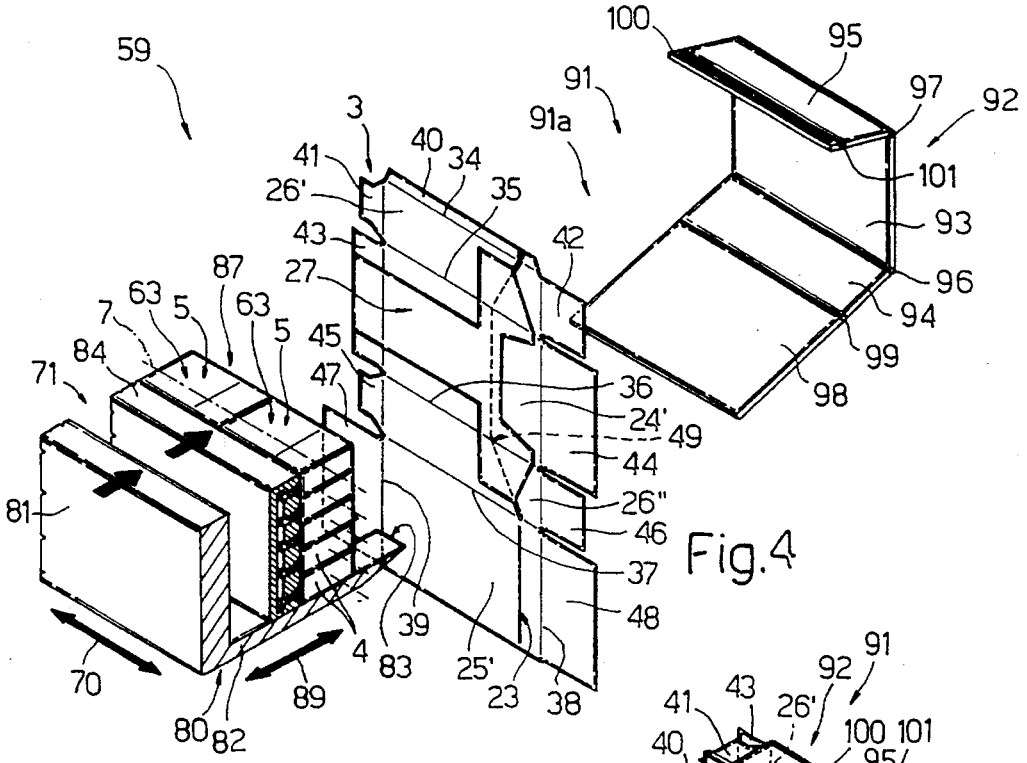
FIGS. 4 to 8 show, with parts in section and parts removed for clarity, the various stages in the formation and folding of the FIG. 2 wrapping for producing the FIG. 1 carton
Figure 5:
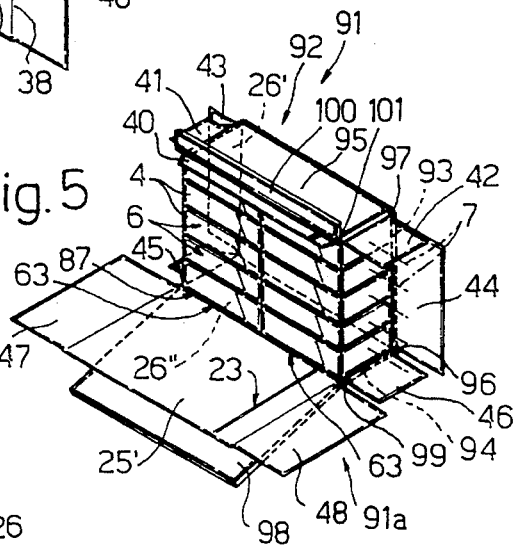

As shown schematically in FIG. 4, cartoning machine 59 comprises a folding unit 91 in turn comprising a folding spindle 92 located at a folding station **91*a* for successively receiving groups 87 from conveyor device 71 and a succession of blanks 3. By means of a known feed device (not shown), each blank 3 is fed to station 91a in time with a respective group 87, and in such a manner as to be positioned crosswise to direction 89, with collar 27 facing device 71**.

Spindle 92 comprises a plate 93 located in a fixed position parallel to and directly facing plate 84 in direction 89; a plate 94 connected to the bottom edge of plate 93 by a hinge 96 parallel to direction 70; a plate 95 connected to the top edge of plate 93 by a hinge 97 parallel to hinge 96; a plate 98 connected to the free edge of plate 94, opposite hinge 96, by a hinge 99 parallel to hinge 96; and a plate 100 connected to the free edge of plate 95, opposite hinge 97, by a hinge 101 parallel to hinge 97. Plates 93, 94, 95, 98 and 100 are substantially the same size as walls 24, 26, 26, 25 and tab 40 respectively; and plates 94, 95, 98 and 100 are connected to respective known actuators (not shown) by which they are rotated in relation to plate 93 to define a tubular wrapping **2*a* (FIG. 7) about group 87**.

Figure 6:
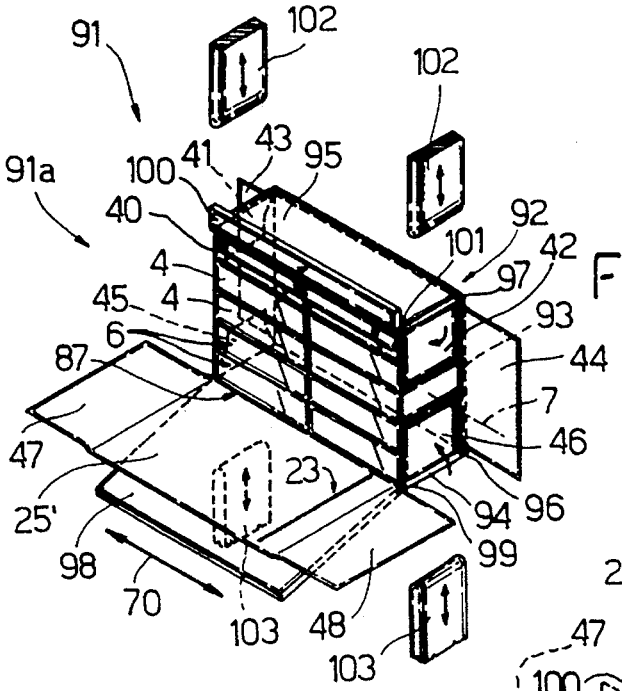
Figure 7:
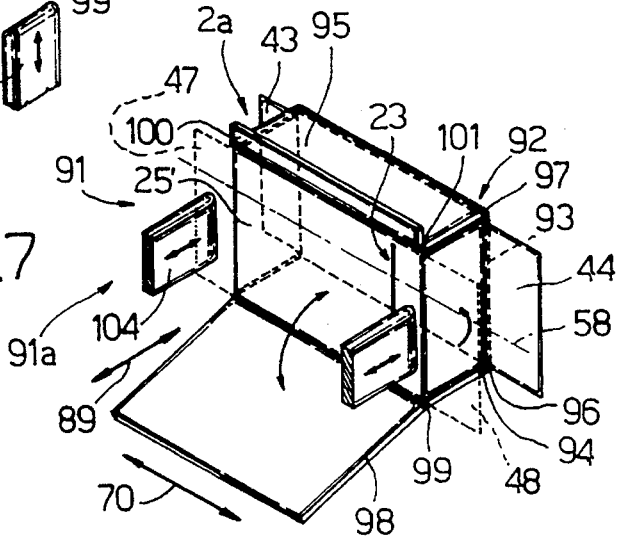
Figure 8:
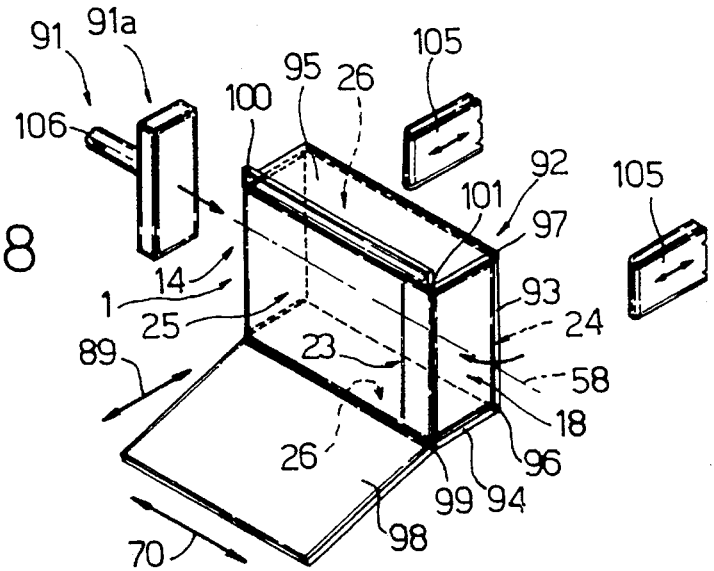

As shown in FIGS. 6, 7 and 8, unit 91 also comprises four pairs of folding elements 102, 103, 104, 105 which, as explained more clearly later on, cooperate with spindle 92 to finish fold blank 3 about a respective group 87 to form carton 1.

As shown in FIG. 8, unit 91 also comprises a pusher 106 for unloading carton 1 from station **91*a***.

Operation of machine 59 will now be described as of the instant in which conveyor device 71 is empty and in the FIG. 3 loading position, and a stack 63—hereinafter indicated **63*a*—is fed by platform 61 to station 65**.

As of the above position, pusher 68 expels stack 63a from pocket 66 on to platform 74 of turnaround station 72 and into contact with stop element 78 in the start position crosswise to direction 70; at which point, pusher 68 is partially withdrawn, and platform 74 is rotated 90° about axis 77 so as to similarly rotate stack 63a and position axes 7 of packets 4 parallel to direction 70.

On being rotated 90° as described above, stack **63*a* is again engaged by pusher 68 which feeds it in direction 70 to device 71 and releases it inside compartment 86, on wall 82, and contacting both plate 84 and appendix 85. Pusher 68 is then withdrawn into the idle position and, upon platform 61 rotating one step, substantially repeats the above cycle to feed a second stack 63—hereinafter indicated 63*b*—into compartment 86 and into contact with stack 63***a*, so that axis 7 of each packet 4 in stack 63*b* is aligned, in direction 70, with axis 7 of the corresponding packet 4 in stack 63a to form a group 87.

At this point, pusher 68 is again withdrawn into the idle position, and device 71 is activated to feed group 87 into folding station 91*a*, in front of which a blank 3 has been positioned, and in which spindle 92 has been set to the FIG. 4 position, i.e. with plate 95 rotated practically square in relation to plate 93, with plate 100 rotated upwards in relation to plate 95, and with plates 94 and 98 substantially coplanar with each other and rotated practically square in relation to plate 93. More specifically, plates 94 and 98 form with plate 93 an angle approximately equal to but no less than 90° plus the end bevel of wall 82, whereas plate 95 may initially be maintained aligned with plate 93 and only subsequently set to the FIG. 4 position.

As device 71 is moved towards station 91*a*, actuating units 88 and 90 are operated simultaneously to move plate 84 forward so that the front edge (in direction 89) of group 87 is flush with edge 83, and edge 83 contacts hinge 96. The above movement of device 71 automatically brings blank 3 into contact with spindle 92, so that blank 3 is substantially folded in a C (or in an L if plate 95 is aligned with plate 93) about group 87. More specifically, blank 3 is positioned with panels 24', 26", 26' and 25' respectively contacting plates 93, 94, 95 and 98.

At this point, actuating units 88 and 90 are operated simultaneously in opposite directions by an amount equal to the thickness of group 87 in direction 89, and so that plate 84 is flush with edge 83, and edge 83 is positioned over hinge 99. During this movement, plates 94 and 95 are respectively raised and lowered gradually so that they are square in relation to plate 93, and so as to grip and retain group 87 on panel 26" of blank 3 and on plate 94, and so permit device 71 to withdraw into the FIG. 3 loading position. In addition to gripping group 87 on panel 26", the closing of spindle 92 also provides for folding both panel 26' and panel 26" squarely in relation to panel 24' and about respective lines 35 and 36.

When fully closed by rotating plates 100 and 98 by 90° about the axes of respective hinges 101 and 99, spindle 92 provides for folding blank 3 about group 87 and so forming a tubular wrapping 2*a*, which is closed by means of gum on the surface of tab 40, and the opposite ends of which are closed by moving elements 102 perpendicularly to plate 95 to fold respective tabs 41 and 42 squarely about respective lines 38 and 39, and by moving elements 103 perpendicular to plate 94 to fold respective tabs 45 and 46 squarely about respective lines 38 and 39.

At this point, a known gumming device (not shown) applies a coating of gum to the outer surface of tabs 41, 42, 45, 46, and elements 104 are moved in direction 89 to fold respective tabs 47 and 48 squarely about respective lines 38 and 39, and so gum them to tabs 41, 45 and 42, 46 respectively. The outer surface of tabs 47 and 48 is also applied a coating of gum by a known gumming device (not shown); and elements 105 are moved in direction 89 to fold respective tabs 43 and 44 squarely about respective lines 38 and 39, and so gum them respectively to tabs 47 and 48.

Carton 1 so formed is positioned with its axis 58 horizontal and parallel to direction 70, and is unloaded from station 91a by a pusher 106 and in a direction parallel to direction 70; at which point, spindle 92 is restored to the open position shown in FIG. 4 and described previously, ready to receive the next group 87 and respective blank 3.

When carton 1 is positioned normally, therefore, with axis 58 upright, each stack 63 defines a respective row 57 inside wrapping 2.

I claim:

1. A method of producing cartons of cigarettes with a rigid hinged-lid wrapping, the method being characterized in that it comprises the steps of:

forming groups of packets of cigarettes by feeding stacks of cigarettes successively along a given path and in a first direction parallel to the longer axes of the packets; successively expelling the stacks from said path in a second direction; rotating each stack 90° about an axis crosswise to said first and second directions, so that said longer axes are parallel to said second direction; and again feeding the stacks, so oriented, in said second direction, so that each stack is positioned end to end alongside another stack, thus forming a respective said group of at least two end to end stacks in which each packet in each stack is laid flat with its longer axis horizontal and aligned with the longer axis of a corresponding packet in the other stack;

feeding a flat blank of said rigid wrapping into a position between said group of at least two end to end stacks and a folding spindle, the spindle facing the group in a direction crosswise to the longer axes of the packets;

and feeding each group, crosswise to the longer axes of the packets and together with said flat blank, into engagement with said spindle, so as to fold the blank in contact with the spindle, and so that the bottom wall of the spindle supports the group with the interposition of a panel of the blank corresponding to a lateral wall of the rigid wrapping.

2. A method as claimed in claim 1, characterized in that each group is fed crosswise to the longer axes of the packets towards said spindle in a third direction 89 crosswise to said second direction.

3. A method as claimed in claim 1, characterized in that each said group is formed on a movable support; said step of feeding each group crosswise to the longer axes of the packets and together with said blank to said spindle being performed by moving said movable support in a substantially horizontal third direction crosswise to said longer axes, so as to bring the movable support into contact with the end wall of the spindle with the interposition of a first panel of said blank corresponding to the front wall of the rigid wrapping, and also into contact with said bottom wall of the spindle with the interposition of the panel of said blank corresponding to said lateral wall of the rigid wrapping and constituting a second panel of the blank; by moving said group along the movable support in said third direction so that the group contacts said first panel; by withdrawing the movable support from said spindle so that the group is positioned on the second panel and on the bottom wall of the spindle; and by gripping the group inside said spindle.

4. A method as claimed in claim 3, characterized in that said end wall of the spindle is a fixed wall crosswise to said third direction; the spindle also comprising, in addition to said end wall and said bottom wall, a top wall and a front wall; said top, bottom and front walls being movable; and the group being gripped inside the spindle by moving said top and bottom walls towards each other and in relation to said end wall.

5. A method as claimed in claim 4, characterized in that it comprises the further step of folding said blank about the respective group to form a tubular wrapping, by moving said front wall into a position substantially parallel to said end wall.

* * * * *